US006164626A

United States Patent [19]

Hile

[11] Patent Number: 6,164,626

[45] Date of Patent: Dec. 26, 2000

[54] APPARATUS FOR HOLDING A WORKPIECE

[75] Inventor: Jeffrey B. Hile, Wexford, Pa.

[73] Assignee: Emerson Electric Co., St. Louis, Mo.

[21] Appl. No.: 09/259,839

[22] Filed: Mar. 1, 1999

[51] Int. Cl.[7] ..... B66F 1/00

[52] U.S. Cl. ..... 254/106; 269/249; 269/143; 254/107; 254/108; 254/134

[58] Field of Search ..... 269/146, 249; 254/106–107, 105, 31, 134

[56] References Cited

U.S. PATENT DOCUMENTS

| | | | |
|---|---|---|---|
| 957,333 | 5/1910 | Hawkins et al. | 254/106 |
| 1,739,488 | 12/1929 | Thayer | 254/106 |
| 2,242,431 | 5/1941 | Lucker | 254/106 |
| 2,718,253 | 9/1955 | Zinke | 254/106 |
| 2,720,125 | 10/1955 | Palik | 254/106 |
| 4,084,792 | 4/1978 | Baron et al. | 254/106 |
| 4,220,322 | 9/1980 | Hobday . | |
| 4,552,337 | 11/1985 | Wille | 254/106 |
| 5,009,134 | 4/1991 | Sorensen et al. . | |
| 5,385,335 | 1/1995 | Wurdack | 254/106 |

*Primary Examiner*—James G. Smith
*Assistant Examiner*—Lee Wilson
*Attorney, Agent, or Firm*—Howrey Simon Arnold & White, LLP

[57] ABSTRACT

An apparatus for moving a movable assembly along a mast is provided. The movable assembly has a bore adapted to receive the mast passing through it. The movable assembly has a release and retain mechanism; a uni-directional drive mechanism; and a switching mechanism for engaging the uni-directional drive mechanism. The switching mechanism has a shaft positioned within the movable assembly, generally oriented parallel to the bore, that is capable of rotational movement around the longitudinal axis of the shaft and axial movement along the longitudinal axis of the shaft. The switching mechanism also has a drive pin attached to the shaft of the switching mechanism that is oriented generally perpendicular to the longitudinal axis of the shaft. The switching mechanism also has a mechanism for affecting the axial movement of the shaft that is preferably in the form of a cam. The release and retain mechanism has a biased release lever defining a slot that is sized to receive the mast. The release lever normally engages the mast and when doing so allows movement of the movable assembly in a first direction along the mast while preventing movement of the movable assembly in a second direction along the mast. The uni-directional drive mechanism has a biased drive lever defining a slot, the slot being sized to receive the mast. The drive lever normally is disengaged from the mast. The drive pin is positioned along the length of the shaft so as to cause the drive lever to engage the mast when the shaft is first rotated to position the drive pin proximal to the drive lever and subsequently displaced longitudinally. By engaging the mast, the drive lever provides incremental movement of the movable assembly in the first direction. Free movement of the assembly in both directions can be accomplished by similar employing a release pin on the shaft to engage the retain and release mechanism.

23 Claims, 5 Drawing Sheets

APPARATUS FOR HOLDING A WORKPIECE

FIELD OF THE INVENTION

This invention is generally related to an apparatus for moving an assembly along a mast. In particular, this invention relates to the use of such a movable assembly in combination with a mast as a bar clamp.

BACKGROUND OF THE INVENTION

The conveyance of a movable assembly along a mast is a characteristic common to several apparatuses or tools, including jacks and bar clamps. A disadvantage in certain of these tools is that movement of the movable assembly, often incorporating a jaw, along the mast is accomplished entirely in small increments.

In other such tools, conveyance of the movable assembly along the mast can either be in small increments or large spans. In the latter mode, the movable assembly may, when disengaged from the mast, be moved freely in both directions along the mast. However, tools capable of movement in two modes are commonly complicated by cumbersome manipulation. Use of the tool may require the operator to use both hands to manipulate multiple actuators (e.g., switches or arms).

An apparatus conveyable along a mast in which conveyance could alternatively be in small increments or large spans and in which such conveyance in either mode could be easily achievable by a single operator using a single hand would be desirable. Such an apparatus would be useful in a variety of applications, including jacks and bar clamps.

SUMMARY OF THE INVENTION

In accordance with one aspect of the invention, there is provided an apparatus for moving a movable assembly along a mast. The movable assembly defines a bore with the bore being sized to receive the mast.

The movable assembly has a switching mechanism comprising a shaft positioned within the movable assembly and generally oriented parallel to the bore. The shaft is capable of rotational movement around the longitudinal axis of the shaft and axial movement along the longitudinal axis. A drive pin attached to the shaft and oriented generally perpendicular to the longitudinal axis of the shaft is provided as is a mechanism for affecting the axial movement of the shaft.

The assembly has a release and retain mechanism having a biased release lever defining a slot with the slot being sized to receive the mast. The release lever normally engages the mast. When engaging the mast, the release lever allows movement of the movable assembly in a first direction along the mast and prevents movement of the movable assembly in a second direction along the mast.

The assembly also has a uni-directional drive mechanism having a biased drive lever defining a slot with the slot being sized to receive the mast. The drive lever normally is disengaged from the mast. The drive lever, however, is positioned to engage the mast when the shaft from the switching mechanism is first rotated to position the drive pin proximal to the drive lever and subsequently displaced longitudinally. When engaging the mast, the drive lever provides for incremental movement of the movable assembly in the first direction.

In accordance with another aspect of the invention, there is provided an apparatus for moving a movable assembly along a mast. The movable assembly defines a bore with the bore being sized to receive the mast.

The movable assembly has a switching mechanism comprising a shaft positioned within the movable assembly and generally oriented parallel to the bore. A switch is positioned at one end of the shaft. Movement of the switch subjects the shaft to rotational movement around its longitudinal axis so as to alternatively engage a release and retain mechanism and a uni-directional drive mechanism.. A drive pin and a release pin attached to the shaft and oriented generally perpendicular to the longitudinal axis of the shaft are provided as is a mechanism for affecting the axial movement of the shaft.

The assembly has a release and retain mechanism having a biased release lever defining a slot with the slot being sized to receive the mast. The release lever normally engages the mast. When engaging the mast, the release lever allows movement of the movable assembly in a first direction along the mast and prevents movement of the movable assembly in a second direction along the mast. The release lever is positioned to disengage from the mast when the shaft from the switching mechanism is first rotated to position the release pin proximal to the release lever and subsequently displaced longitudinally. When disengaged from the mast, the release lever allows free movement of the movable assembly in both the first and second directions along the mast The assembly also has a uni-directional drive mechanism having a biased drive lever defining a slot with the slot being sized to receive the mast. The drive lever normally is disengaged from the mast. The drive lever, however, is positioned to engage the mast when the shaft from the switching mechanism is first rotated to position the drive pin proximal to the drive lever and subsequently displaced longitudinally. When engaging the mast, the drive lever provides for incremental movement of the movable assembly in the first direction.

The release and drive pins are positioned at different orientations around the longitudinal axis of the shaft so as to preclude simultaneous engagement of the release and retain mechanism and the uni-directional drive mechanism.

In accordance with another aspect of the invention, there is provided an apparatus for moving a movable assembly along a mast. The movable assembly defines a bore with the bore being sized to receive the mast. A movable jaw with an engaging surface is coupled to the movable assembly, so as to face in a first direction along the mast and move with the moveable assembly. The apparatus also has a fixed jaw with an engaging surface. The fixed jaw is adapted for mounting to one end of the mast such that the engaging surface of the fixed jaw faces in a second direction along the mast toward the opposite end of the mast. The movable assembly is positioned along the mast such that the engaging surface of the movable jaw faces the engaging surface of the fixed jaw.

The movable assembly has a switching mechanism comprising a shaft positioned within the movable assembly and generally oriented parallel to the bore. A switch is positioned at one end of the shaft. Movement of the switch subjects the shaft to rotational movement around its longitudinal axis so as to alternatively engage a release and retain mechanism and a uni-directional drive mechanism.. A drive pin and a release pin attached to the shaft and oriented generally perpendicular to the longitudinal axis of the shaft are provided as is a mechanism for affecting the axial movement of the shaft.

The assembly has a release and retain mechanism having a biased release lever defining a slot with the slot being sized to receive the mast. The release lever normally engages the mast. When engaging the mast, the release lever allows movement of the movable assembly in a first direction toward the fixed jaw and prevents movement of the movable assembly in a second direction away from the fixed jaw. The release lever is positioned to disengage from the mast when the shaft from the switching mechanism is first rotated to position the release pin proximal to the release lever and subsequently displaced longitudinally. When disengaged from the mast, the release lever allows free movement of the movable assembly both toward and away from the fixed jaw.

The assembly also has a uni-directional drive mechanism having a biased drive lever defining a slot with the slot being sized to receive the mast. The drive lever normally is disengaged from the mast. The drive lever, however, is positioned to engage the mast when the shaft from the switching mechanism is first rotated to position the drive pin proximal to the drive lever and subsequently displaced longitudinally. When engaging the mast, the drive lever provides for incremental movement of the movable assembly toward the fixed jaw.

The release and drive pins are positioned at different orientations around the longitudinal axis of the shaft so as to preclude simultaneous engagement of the release and retain mechanism and the uni-directional drive mechanism.

While the invention is susceptible to various modifications and alternative forms, specific embodiments have been shown by way of example in drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

In one embodiment of the present invention, there is provided a movable assembly 10 that can be conveyed in a first direction 11 along a mast 14, movement being in controlled, small increments. In various applications, the combination of the assembly 10 and mast 14 can be utilized as a bar clamp, a jack, or other devices or tools in which it is desirable to achieve controlled movement of an assembly 10 along a mast 14 in small increments relative to the overall length of the mast 14.

For the purposes of the present invention a mast 14 can assume a variety of forms. A mast 14, for example, can be and preferably is a cylindrical tube. Alternatively, an acceptable mast 14 may have a substantially rectangular, square, or even triangular cross-section. The mast 14 may have a cross-section substantially in the form of an I-beam. The principal characteristics of an acceptable mast 14, owing to the typical purposes for which the combination of assembly 10 and mast 14 will generally be employed, are that the axial length over which the assembly 10 is to be conveyed will be greater than either the height or width of a cross-section cut perpendicular to the longitudinal axis of the mast 14 and that the external shape and size of the cross-section will remain substantially constant over the length of the mast 14. Additionally, the mast 14 may be constructed of a variety of materials, including various metals, plastics, and composites. The mast 14 may be solid or hollow. Examples of masts include metal and plastic pipes as well as metal and plastic bars.

Figure 1:
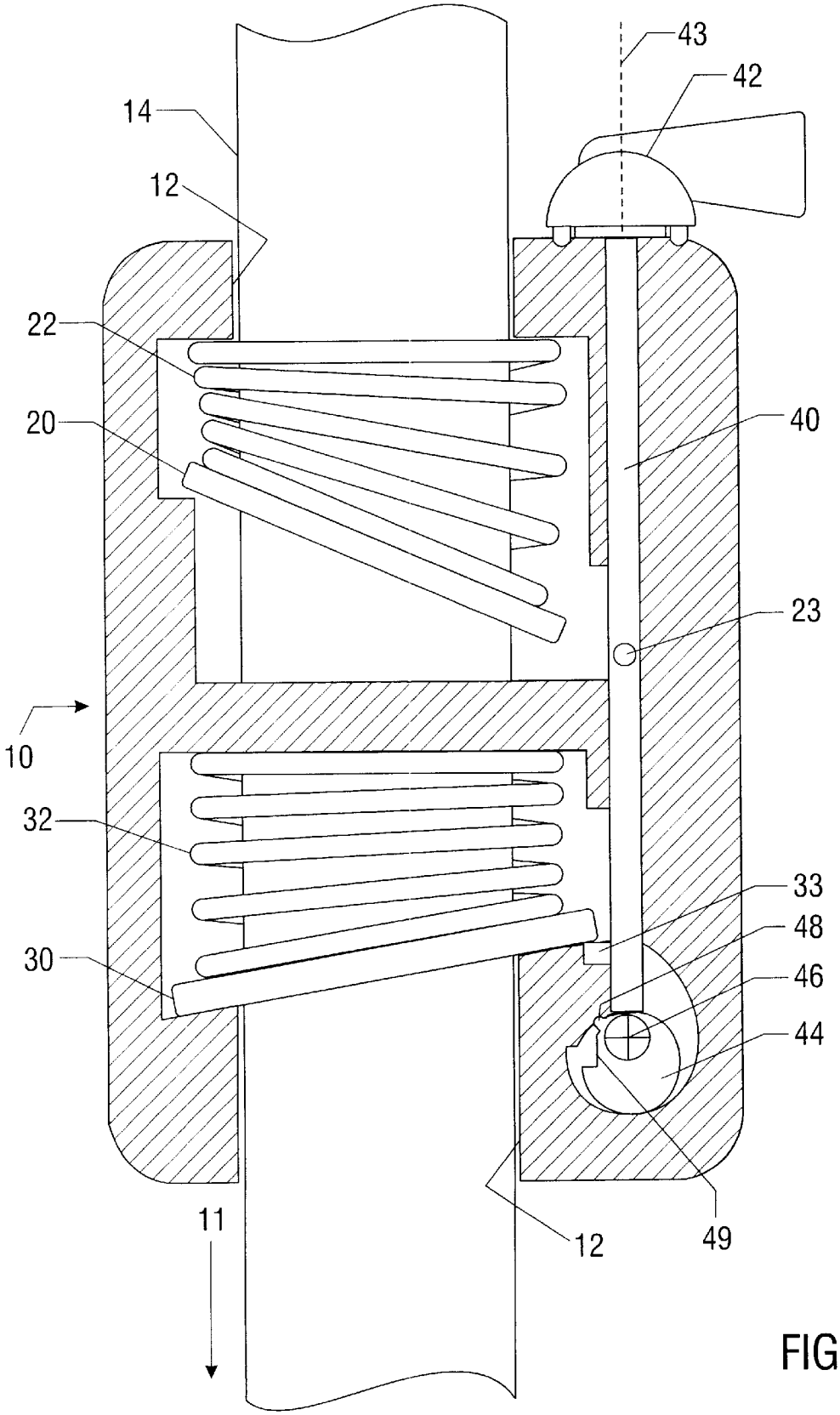
FIG. 1 illustrates a movable assembly of the invention with the uni-directional drive mechanism engaged.

In the present embodiment, there is provided, as indicated in FIG. 1, a movable assembly 10. The assembly 10 has a bore 12 passing through it. The bore 12 is sized and shaped to receive a mast 14, allowing the mast 14 to pass through assembly 10. Integrated into assembly 10, there is a release and retain mechanism, a uni-directional drive mechanism, and a switching mechanism for engaging the uni-directional drive mechanism and in some embodiments for alternatively engaging the release and retain mechanism. The components of these three mechanisms integrated into movable assembly 10 are subsequently described.

Figure 2:
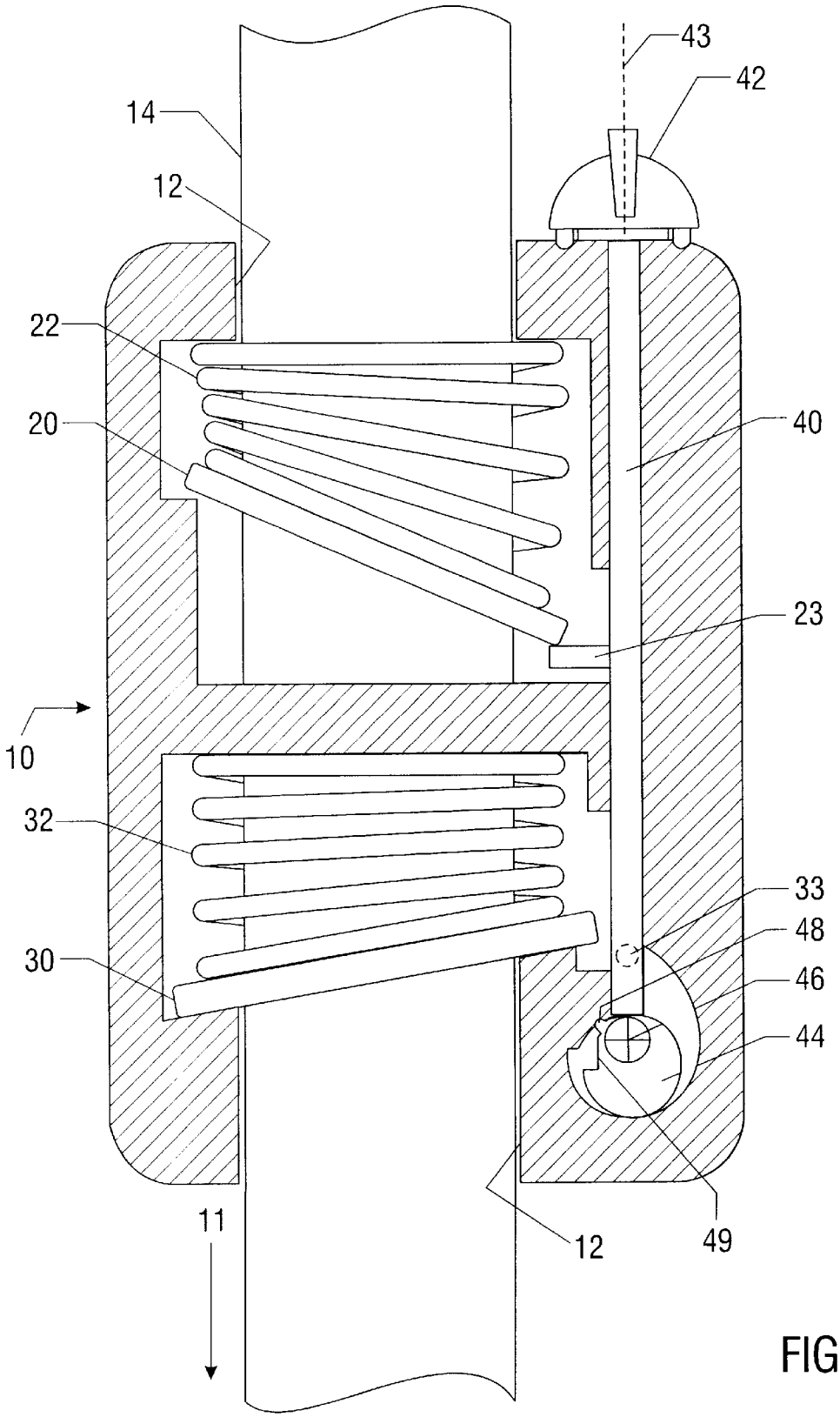
FIG. 2 illustrates a movable assembly of the invention with the release and retain mechanism engaged.
Figure 3:
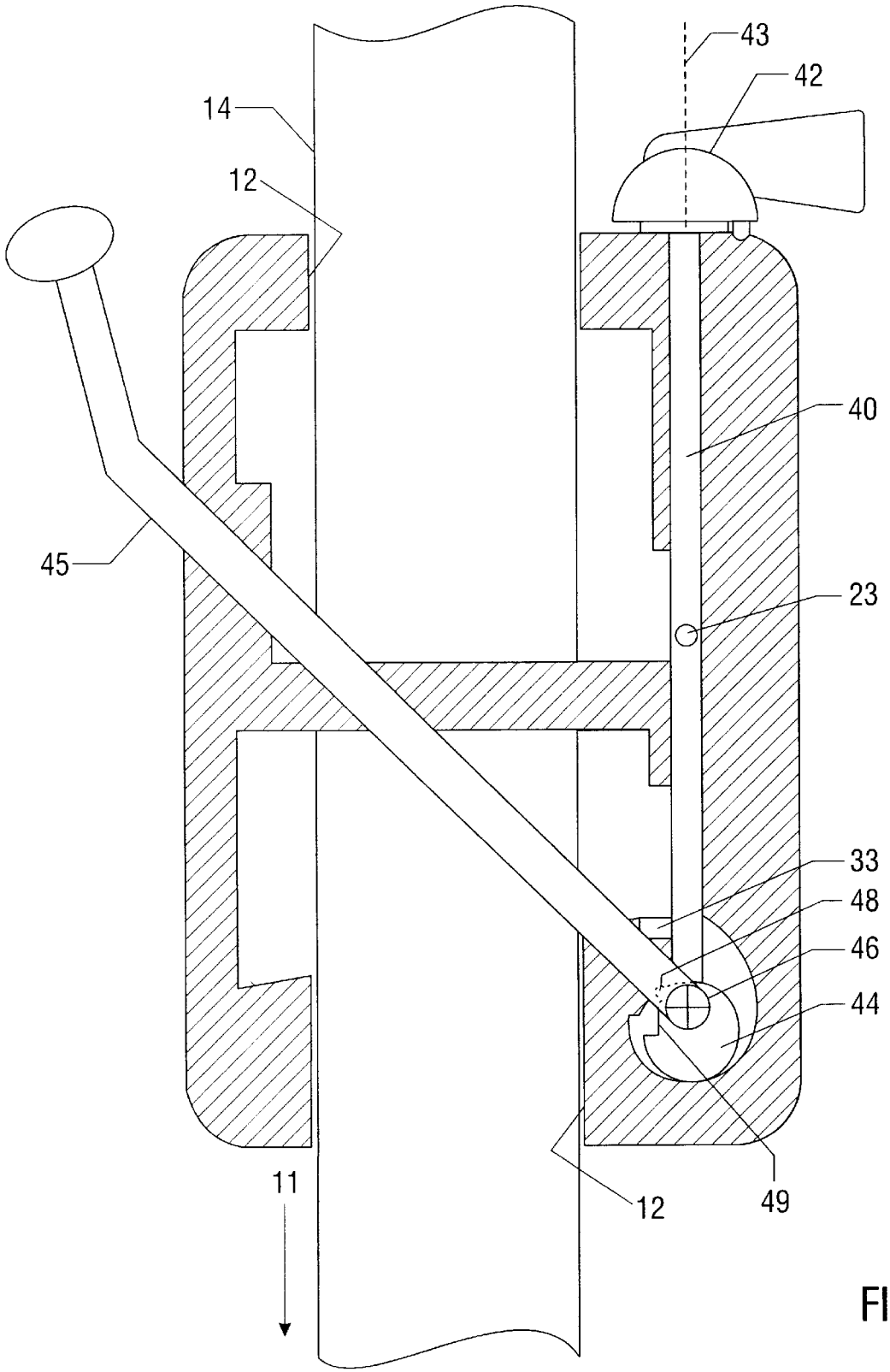
FIG. 3 illustrates a movable assembly of the invention with the uni-directional drive mechanism engaged and with an arm provided to actuate rotation of a cam.

The release and retain mechanism, such as illustrated generally in FIGS. 1–3, has a biased, slotted release lever 20. The slot is shaped and sized to receive the mast 14. The release lever 20 is biased, preferably but not necessarily by means of spring 22, toward the direction of intended movement of the movable assembly. This direction is given by the arrow 11. The release lever 20 is normally positioned transverse to but not perpendicular to the mast 14 such that the release lever 20 normally engages the mast 14 (e.g., is in binding resistance to the mast). When engaged to the mast 14 in this manner, the release lever 20 allows movement of movable assembly 10 along the mast in a first, intended direction 11 but prevents movement of the movable assembly 10 along the mast 14 in the opposite direction.

In other embodiments in which it is desirable that the movable assembly 10 be capable of moving in either direction along the mast. Such is provided by a release pin 23 and shaft 40, to which release pin 23 is attached, of a subsequently described switching mechanism. Release pin 23 is oriented transverse to, preferably perpendicular to, the shaft 40. Release pin 23 is positioned along the shaft 40 at a point so as to cause the release lever 20 to be disengaged from the mast 14 when the shaft 40 is first rotated to position the release pin 23 proximal to and under the release lever 20 and then when the shaft 40 is subsequently displaced axially. When the release lever 20 is displaced and therefore disengaged from the mast 14 in the manner described, the movable assembly 10 can be freely slid in both directions along the mast 14. In this manner, the movable assembly 10 can be moved in small increments or over large spans as the release lever 20 provides no resistance to movement in either direction along the mast 14.

The uni-directional drive mechanism, such as illustrated generally in FIGS. 1–3, has a biased, slotted drive lever 30. The slot is shaped and sized to receive the mast 14. The drive lever is biased, preferably by means of spring 32, toward the direction of intended movement of the movable assembly 10. This direction is again given by the arrow 11. The drive lever 30 is normally positioned transverse to but not perpendicular to the mast 14 such that the drive lever 30 is normally disengaged from the mast 14 (e.g., is not in binding resistance to the mast).

The uni-directional drive mechanism is engaged by a drive pin 33 of a subsequently described switching mechanism. The drive pin 33 is attached to shaft 40 and is oriented transverse to, and preferably perpendicular to, the shaft 40. The drive pin 33 is positioned along the shaft 40 at a point so as to cause the drive lever 30, previously disengaged from the mast 14, to pivot around the end of the drive lever 30 opposite the drive pin 33 when the shaft 40 is first rotated to position the drive pin 33 proximal to and under the drive lever 30 and then when the shaft 40 is subsequently displaced axially. The end of the drive lever 30 adjacent and in contact with the drive pin 33 then moves in a direction opposite the intended direction 11 of movement of the assembly 10. This movement compresses spring 32, or other biasing means, and eventually causes the drive lever 30, previously disengaged from the mast 14, to engage and bind against the surface of the mast 14. Additional axial displacement of the shaft 40 causes the drive lever 30 to move further in a direction opposite the intended direction 11 of movement of the movable assembly 10. Movement of the drive lever 30, being engaged to the mast 14, translates into movement of the mast 14 in a direction opposite the intended direction 11 of movement of the movable assembly 10 and therefore movement of the movable assembly 10 in the intended direction 11 along the mast 14.

The release pin 23 and the drive pin 33, encompassing components of the switching mechanism are positioned at different angles on the rotational plane of the subsequently described shaft 40 of the switching mechanism such that simultaneous engagement of the release and retain mechanism and the uni-directional drive mechanism is precluded. Preferably, the release pin 23 and drive pin 33 have at least about 90° of separation between them. More preferably, the release and drive pins have 90° of separation between them.

The switching mechanism, such as illustrated generally in FIGS. 1–3, preferably retain consists of shaft 40 positioned within the movable assembly 10 and generally oriented parallel to the bore 12. A switch 42 is coupled to the shaft 40, preferably positioned at one end of the shaft 40, in a manner such that rotation of the switch 42 causes rotation of the shaft 40 around its longitudinal axis 43. Rotation of the switch 42 and the concomitant rotation of the shaft 40 results in the engagement of the uni-directional drive mechanism in a manner subsequently described, and in some embodiments the alternative engagement of the release and retain mechanism. The switching mechanism also consists of release pin 23 and drive pin 33 as previously disclosed.

The switching mechanism, such as illustrated generally in FIGS. 1–5, also has a mechanism for achieving axial movement of the shaft 40. In a preferred embodiment, as illustrated for example in FIGS. 3 and 4, the mechanism for achieving axial movement of the shaft 40 is provided by a cam 44 and an arm 45 coupled to the cam 44 so as to achieve rotation of the cam 44.

The illustrated cam 44 provides axial movement of the shaft 40 because the rotational center 46 or axis of rotation of the cam 44 is offset from the physical center of the cam 44. From FIGS. 1–4, it should be evident to one of ordinary skill in the art that the maximum axial displacement of the shaft 40 is given by the difference between the maximum distance between the rotational center 46 of the cam 44 and the cam surface and the minimum distance between the rotational center 46 of the cam 44 and the cam surface.

Movement of the cam 44 by the arm 45 can, as should be understood by one of ordinary skill in the art, be achieved by either rotating the arm 45 around its longitudinal axis or by moving the arm 45 through a plane occupied by its longitudinal axis, the precise method being controlled by the manner in which the arm 45 and cam 44 are coupled. Movement of the arm 45 through a plane occupied by its longitudinal axis is contemplated in FIGS. 3 and 4.

In a preferred embodiment, illustrated in FIGS. 1–4, the cam 44 is shown in its neutral position in which the movable assembly 10 exhibits no movement regardless of whether the release and retain mechanism or the uni-directional drive mechanism has been engaged by rotation of the shaft 40. In this neutral position, the rotational center 46 of the cam 44 is preferably positioned adjacent the shaft 40 such that the distance between the rotational center 46 and the shaft 40 is the aforementioned minimum distance between the rotational center 46 of the cam 44 and the cam surface. As contemplated in FIGS. 1–4, counter-clockwise rotation of the cam 44 from this neutral position causes the gradual but continuous axial displacement of the shaft 40.

When the assembly 10 is in the uni-directional drive mode as illustrated in FIG. 40 causes a substantially equal displacement of the drive pin 33. The displacement of the drive pin 33 causes the drive lever 30 to pivot around the end of the drive lever 30 opposite the drive pin 33. The end of the drive lever 30 adjacent and in contact with the drive pin 33 moves in a direction opposite the intended direction 11 of movement of the assembly 10. This movement compresses spring 32, or other biasing means, and eventually causes the drive lever 30, previously disengaged from the mast 14, to engage and bind against the surface of the mast 14. Additional counter-clockwise rotation of the cam 44 causes the drive lever 30 to move further in a direction opposite the intended direction 11 of movement of the movable assembly 10. Movement of the drive lever 30, being engaged to the mast 14, translates into movement of the mast 14 in a direction opposite the intended direction 11 of movement of the movable assembly 10. From a different perspective, the movable assembly 10 moves in the intended direction 11 along the mast. Maximum movement of the movable assembly 10 in a given rotational cycle of the cam 44 will in various embodiments be limited either by the full compression of spring 32, or other biasing means, or by the maximum stroke of the arm 45 or rotation of the cam 44.

While in some embodiments of the present invention it may be desirable to only move the movable assembly 10 in one direction 11 along the mast 14, in other embodiments, it will be desirable to move the movable assembly 10 in either direction along the mast 14. In such embodiments, the release and retain mechanism provides means for achieving movement of the movable assembly 10 in both directions along the mast 14. When the movable assembly 10 is in the release and retain mode, with the release and retain mechanism engaged, axial displacement of the shaft 40 causes a substantially equal displacement of the release pin 23. FIG. 2 illustrates an assembly 10 with the release and retain mechanism engaged, release pin 23 positioned adjacent and under release lever 20. The displacement of the release pin 23 causes the release lever 20, previously engaged to the mast 14, to be disengaged from the mast 14. Whereas before, the binding resistance of the release lever 20 to the mast 14 allowed movement of the movable assembly 10 in an intended direction 11 along the mast 14 (the direction in which movement is obtained by the uni-directional drive mechanism) but prevented movement of the movable assembly 10 in the opposite direction, the release lever 20 now disengaged from the mast 14 provides no opposition to movement of the movable assembly 10 in either direction along the mast 14. The movable assembly 10 can be conveyed in either direction along the mast 14 in either small increments or in large spans.

In the release and retain mode, axial displacement of the shaft 40 and therefore displacement of the release pin 23 and release lever 20 can be achieved by the previously described counter-clockwise rotation of the cam 44. However, this means of achieving displacement of the release pin 23 and release lever 20 is not preferred. Because the release lever 20 is biased against the described displacement, the release lever 20 will have a tendency to re-engage the mast 14 and prevent movement unless continuous resistance to the rotation of the cam 44 is provided to the arm 45. Accordingly, in a preferred cam 44, such as illustrated in FIG. 2, it is preferred that the release and retain mechanism be engaged and the release pin 23 and the release lever 20 be displaced by rotating the cam 44 clockwise. This preferred cam has a nub 48 positioned on the exterior surface of the cam 44 in a position such that clockwise rotation of the cam 44 will cause the nub 48 to axially displace the shaft 40 and therefore to displace the release pin 23 and release lever 20.

Clockwise rotation of the cam 44 in this manner achieves constant disengagement of the release lever 20 from the mast 14 without necessitating that a continuous resistance to the rotation of the cam 44 be provided to the arm 45. In this preferred embodiment, the displacement provided by the nub 48 does not have to be significant. The displacement provided by the nub 48, and therefore the size of the nub 48, only has to be sufficient to cause the release lever 20 to disengage from the mast 14. In a variation of this embodiment, a notch 49 is provided on the exterior surface of the cam 44 at a point in the clockwise rotation of the cam 44 after the nub 48. This notch 49 preferably limits the clockwise rotation of the cam 44 to an amount sufficient to position the nub 48 under the shaft 40.

In a preferred switching mechanism, rotation of the switch 42 and therefore the shaft 40 is limited. In this preferred embodiment, the rotational extremes of the switch 42 are positioned such that one extreme defines the point at which the release and mechanism is engaged (the release pin 23 is positioned so as to displace the release lever 20) and the other extreme defines the point at which the uni-directional drive mechanism is engaged (the drive pin 33 is positioned so as to displace the drive lever 30).

In various embodiments, detents can be placed on the surface of the movable assembly at the rotational extremes so as to maintain the switch 42 in the desired position. The detents can and preferably are employed with a dimple, or dimples, positioned on the underside of the switch 42 adapted for receiving the detents.

Figure 4:
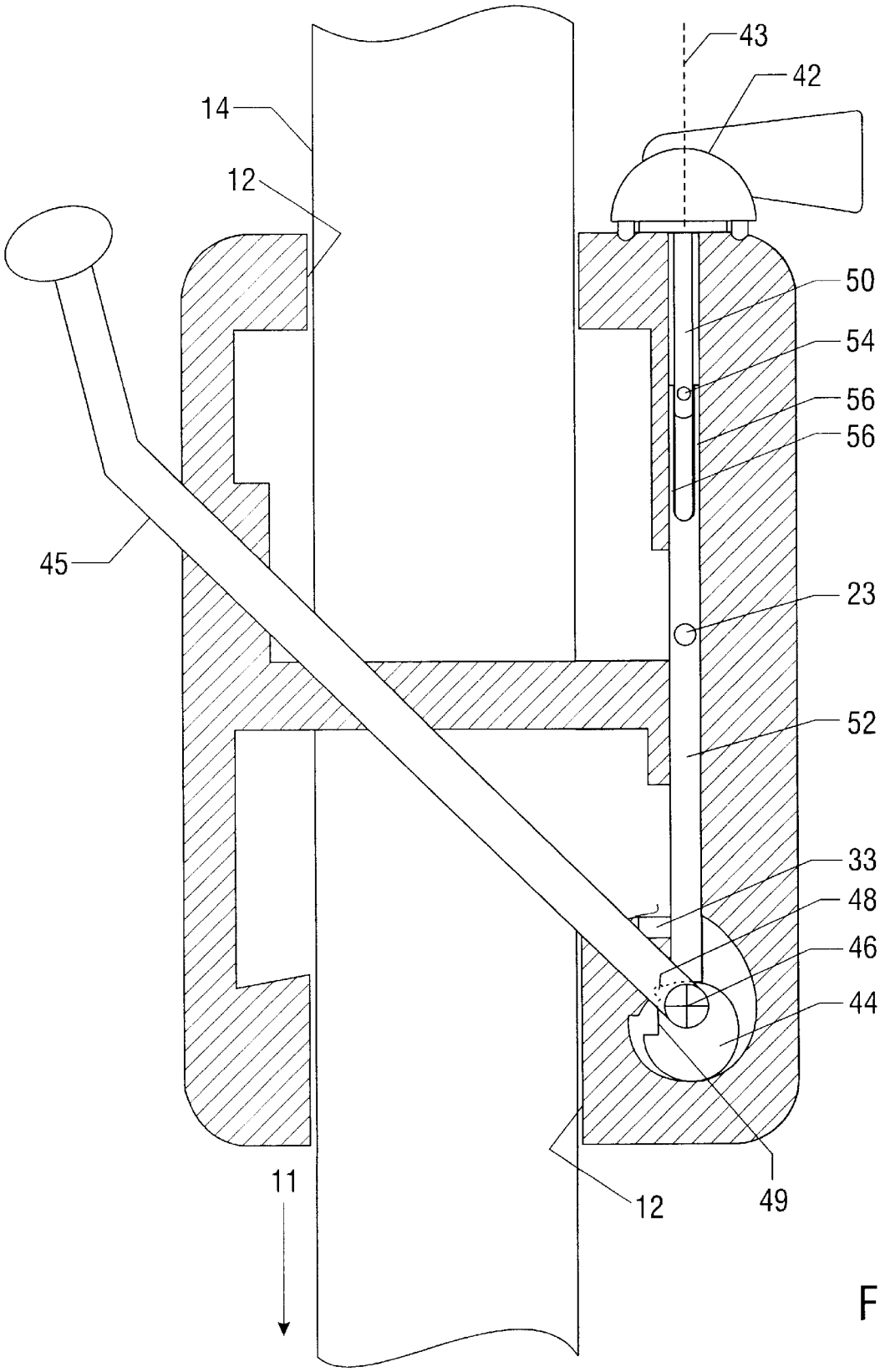
FIG. 4 illustrates a movable assembly of the invention with the uni-directional drive mechanism engaged, with an arm provided to actuate rotation of a cam, and with a switching mechanism having a shaft that is divided into a first and second stem.

In another preferred switching mechanism, illustrated in FIG. 4, the shaft is divided into a first stem 50 and a second stem 52. One end of the first stem 50 is coupled to switch 42. At the other end of the first stem 50, there is located at least one pin 54 that is oriented transverse to and preferably perpendicular to the first stem 50. Preferably, two pins 54 are positioned 180° from each other at the same height on the first stem 50. Even more preferably, a two-pin arrangement is provided by passing a single, extended pin through a hole in the first stem 50.

One end of the second stem 52 has forked extensions 56 that are designed to mate the pin(s) 54 of the first stem 50. The mated pin(s) 54 and forked extensions 56 enable rotation of the second stem 52 when the switch 42 and first stem 50 are likewise rotated. The other end of the second stem 52 is positioned next to the cam 44 or other mechanism for affecting axial movement of the shaft. When this split shaft is employed, the release pin 23 and drive pin 33 of the release and retain mechanism and the uni-directional drive mechanism are both positioned on the second stem 52. The separation of the shaft into a first stem 50 and second stem 52 as described allows for axial displacement of the second stem 52 without a concomitant displacement of the first stem 50 or switch 42.

It should be understood, that the placement of the release and retain mechanism and the uni-directional drive mechanism in the manner illustrated in FIGS. 1 and 2, with the uni-directional drive mechanism positioned forward of the release and retain mechanism relative to the intended direction 11 of conveyance along the mast 14 is not intended as a requirement of the invention. Likewise, the placement of the release lever 20 and drive lever 30 within separate cavities, as illustrated in FIGS. 1 and 2, in the movable assembly 10 is not a requirement of the present invention. Also, the placement of cam 44 or other mechanism for affecting axial movement of the shaft 40 forward of switch 42 relative to the intended direction 11 of conveyance is not a requirement of the invention. These and other aspects of the present invention can be varied within the scope of the invention in manners that should be apparent to one of ordinary skill in the art having the benefit of this disclosure.

Figure 5:
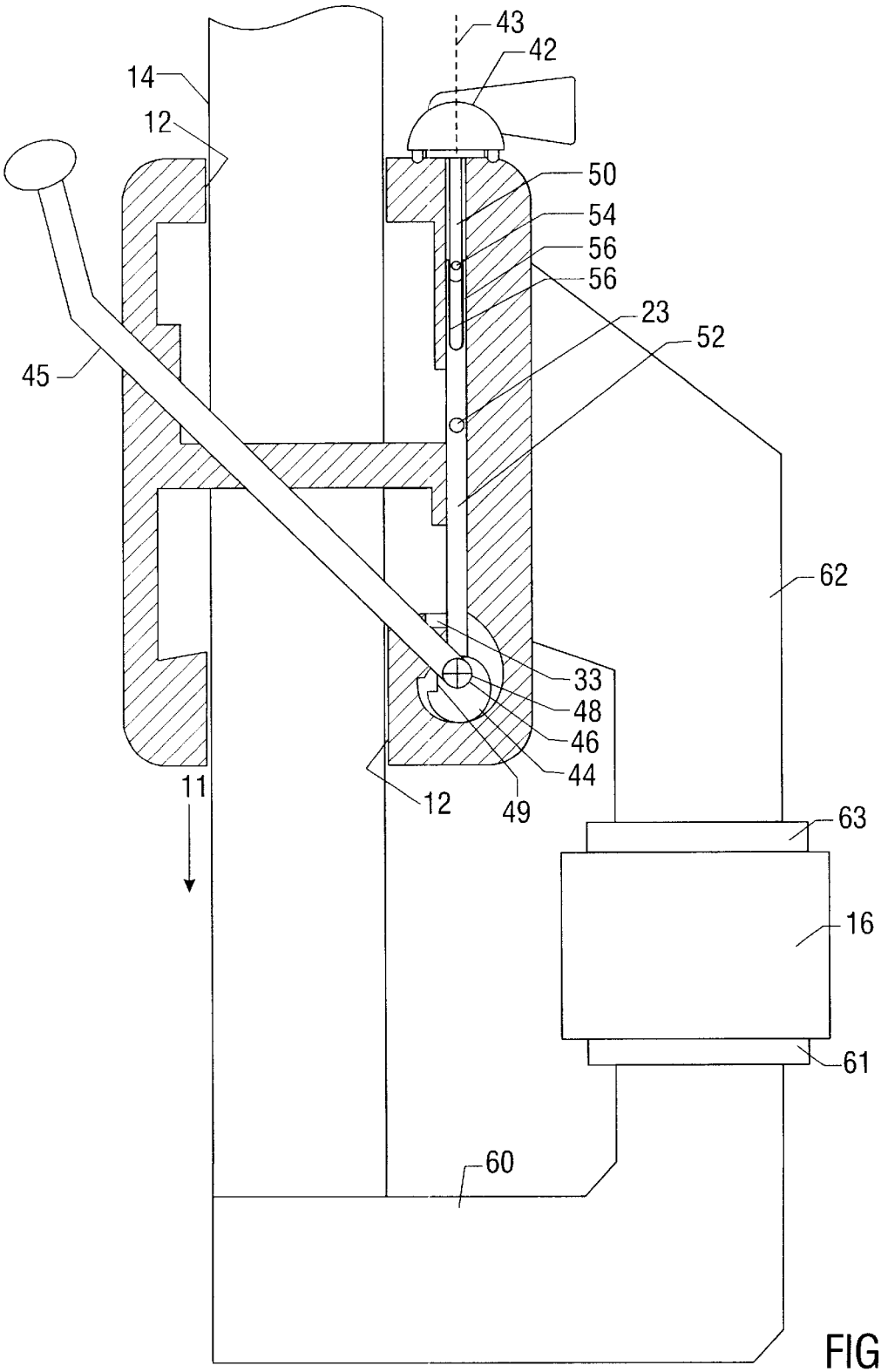
FIG. 5 illustrates a bar clamp utilizing a movable assembly of the invention with the uni-directional drive mechanism engaged, with an arm provided to actuate rotation of a cam, and with a switching mechanism having a shaft that is divided into a first and second stem.

In various embodiments, the combination of the movable assembly 10 and a mast 14 can be employed to achieve several different objectives. A particularly preferred use of a movable assembly 10 and a mast 14 would be as a bar clamp. Such an embodiment is illustrated in FIG. 5. In such an arrangement, the combination of the movable assembly 10 and mast 14 would be used to hold a workpiece 16 in place or to hold two articles together. In such an embodiment, the mast 14 would have a fixed jaw 60 with an engaging surface 61 mounted at one end of the mast 14. The engaging surface 61 would face the opposite end of the mast. Clamping and therefore the intended direction 11 of movement of the movable assembly 10 obtained by the uni-directional drive mechanism would be towards the engaging surface 61 of the fixed jaw 60.

The movable assembly 10 in such an embodiment would have coupled to it an additional jaw 62 having an engaging surface 63. This additional jaw 62 is movable at the least to the extent that it is coupled to and moves with the movable assembly 10. The additional, or movable, jaw 62 is coupled to the movable assembly 10 in a manner such the engaging surface 63 of the movable jaw 62 faces in the same intended direction 11 that the movable assembly 10 will be conveyed in along the mast 14 by the uni-directional drive mechanism.

In such an embodiment in which the movable assembly 10 is positioned on the mast 14 such that the direction of movement obtainable by the uni-directional drive mechanism is toward the engaging surface 61 of the fixed jaw 60, the controlled, incremental movement of the movable assembly 10 achieved by means of the uni-directional drive mechanism will cause the distance between the engaging surfaces 61 and 63 of the fixed 60 and movable 62 jaws to decrease. Eventually, the controlled, incremental movement of the movable assembly 10 will cause a workpiece 16 positioned between the fixed 60 and movable 62 jaws to become fixed in place. In such an embodiment, controlled, incremental movement will cease when the resisting force provided by the workpiece 16 exceeds the displacing force that can be provided to the mast 14 by We drive-lever 30 of the uni-directional drive mechanism.

Similarly, the release and retain mechanism could be used in such an embodiment to retract the movable assembly 10 and movable jaw 62 away from the workpiece 16. The release and retain mechanism could also be used to quickly position the movable assembly 10 and movable jaw 62 adjacent the workpiece 16 so that the conveying distance to be achieved by the uni-directional drive mechanism is minimized. Movement of the movable assembly 10 over a final distance to achieve ultimate clamping of the workpiece 16 will in most instances be achieved by the uni-directional drive mechanism as the clamping force obtained with the uni-directional drive mechanism will invariably exceed the clamping force achievable with the release and retain mechanism alone.

What is claimed is:

1. An apparatus for moving a movable assembly along a mast comprising a movable assembly defining a bore passing through the movable assembly, the bore being sized to receive the mast;

a switching mechanism comprising a shaft positioned within the movable assembly generally oriented parallel to the bore, the shaft being capable of rotational movement around the longitudinal axis of the shaft and axial movement along the longitudinal axis, a drive pin attached to the shaft and oriented generally perpendicular to the longitudinal axis of the shaft, and a mechanism for affecting the axial movement of the shaft;

a release and retain mechanism comprising a biased release lever defining a slot, the slot being sized to receive the mast, the release lever normally engaging the mast, the release lever when engaging the mast allowing movement of the movable assembly in a first direction along the mast and preventing movement of the movable assembly in a second direction along the mast; and a uni-directional drive mechanism comprising a biased drive lever defining a slot, the slot being sized to receive the mast, the drive lever normally being disengaged from the mast; the drive lever being positioned to engage the mast when the shaft from the switching mechanism is first rotated to position the drive pin proximal to the drive lever and subsequently displaced longitudinally, the drive lever when engaging the mast providing incremental movement of the movable assembly in the first direction.

2. The apparatus of claim 1 wherein at least one of the release and drive lever is biased with a spring.

3. The apparatus of claim 1 wherein the biased release lever, when normally engaging the mast, and the biased drive lever, when normally disengaged from the mast, are positioned transverse to the mast but not perpendicular to the mast.

4. The apparatus of claim 1 wherein the release and drive levers define circular slots.

5. The apparatus of claim 1 wherein the mechanism for affecting the axial movement of the shaft comprises a cam positioned within the movable assembly and adjacent the shaft so as to subject the shaft to axial movement along its longitudinal axis and an arm extending from the movable assembly and coupled to the cam so as to achieve the axial movement.

6. The apparatus of claim 1 wherein said switching mechanism further comprises a release pin attached to the shaft and oriented generally perpendicular to the longitudinal axis of the shaft, the release pin positioned along the length of the shaft so as to cause the release lever to be disengaged from the mast when the shaft is first rotated to position the release pin proximal to the release lever and subsequently displaced longitudinally, the release lever when disengaged from the mast allowing free movement of the movable assembly in both the first and second directions along the mast.

7. An apparatus for moving a movable assembly along a mast comprising a movable assembly defining a bore passing through the movable assembly, tie bore being sized to receive the mast;

a switching mechanism comprising a shaft positioned within the movable assembly generally oriented parallel to the bore, a switch positioned at one end of the shaft, movement of the switch subjecting the shaft to rotational movement around its longitudinal axis so as to alternatively engage a release and retain mechanism and a uni-directional drive mechanism, a release pin attached to the shaft and oriented generally perpendicular to the longitudinal axis of the shaft, a drive pin attached to the shaft and oriented generally perpendicular to the longitudinal axis of the shaft, and a mechanism for affecting the axial movement of the shaft;

a release and retain mechanism comprising a biased release lever defining a slot, the slot being sized to receive the mast, the release lever normally engaging the mast, the release lever when engaging the mast allowing movement of the movable assembly in a first direction along the mast and preventing movement of the movable assembly in a second direction along the mast, the release lever being positioned to disengage from the mast when the shaft from the switching mechanism is first rotated to position the release pin proximal to the release lever and subsequently displaced longitudinally, the release lever when disengaged from the mast allowing free movement of the movable assembly in both the first and second directions along the mast;

a uni-directional drive mechanism comprising a biased drive lever defining a slot, the slot being sized to receive the mast, the drive lever normally being disengaged from the mast; the drive lever being positioned to engage the mast when the shaft from the switching mechanism is first rotated to position the drive pin proximal to the drive lever and subsequently displaced longitudinally, the drive lever when engaging the mast providing incremental movement of the movable assembly in the first direction; and said release and drive pins being positioned at different orientations around the longitudinal axis of the shaft so as to preclude simultaneous engagement of the release and retain mechanism and the uni-directional drive mechanism.

8. The apparatus of claim 7 wherein at least one of the release and drive lever is biased with a spring.

9. The apparatus of claim 7 wherein the biased release lever, when normally engaging the mast, and the biased drive lever, when normally disengaged from the mast, are positioned transverse to the mast but not perpendicular to the mast.

10. The apparatus of claim 7 wherein the release and drive levers define circular slots.

11. The apparatus of claim 7 wherein the mechanism for affecting the axial movement of the shaft comprises a cam, the rotational center of the cam being offset from the physical center of the cam, the cam positioned within the movable assembly and adjacent the shaft so as to subject the shaft to axial movement along its longitudinal axis when the cam is rotated, and an arm extending from the movable assembly and coupled to the cam so as to achieve the axial movement.

12. The apparatus of claim 11 wherein the cam has a nub positioned on the exterior surface of the cam.

13. The apparatus of claim 7 wherein the shaft is comprised of a first stem and a second stem; said first stem coupled at one end to the switch and having at least one transverse pin at the other end; and the second stem having a first end with two forked extensions, the extensions straddling the transverse pin of the first stem, and a second end positioned adjacent to the mechanism for affecting the axial movement of the shaft;

wherein rotation of the switch causes the rotation of the first stem and the second stem.

14. The apparatus of claim 13 wherein the release pin and the drive pin are positioned on the second stem and wherein axial movement of the second stem occurs without a concomitant axial movement of the first stem and switch.

15. The apparatus of claim 7 wherein the apparatus is a clamp and wherein the apparatus further comprises a fixed jaw with an engaging surface; and a movable jaw with an engaging surface coupled to said movable assembly so as to move with the moveable assembly;

said fixed jaw being adapted for mounting to one end of said mast such that the engaging surface of the fixed jaw faces in the second direction toward the opposite end of the mast; and said movable assembly being positioned along the mast such that the engaging surface of the movable jaw faces in the first direction toward the engaging surface of the fixed jaw.

16. An apparatus for moving an assembly along a mast comprising a movable assembly defining a bore passing through the movable assembly, the bore being sized to receive the mast; a movable jaw with an engaging surface coupled to the movable assembly so as to face in a first direction along the mast and move with the moveable assembly;

a fixed jaw with an engaging surface wherein the fixed jaw is adapted for mounting to one end of said mast such that the engaging surface of the fixed jaw faces in a second direction along the mast toward the opposite end of the mast;

said movable assembly being positioned along the mast such that the engaging surface of the movable jaw faces the engaging surface of the fixed jaw;

a switching mechanism comprising a shaft positioned within the movable assembly generally oriented parallel to the bore, a switch positioned at one end of the shaft, movement of the switch subjecting the shaft to rotational movement around its longitudinal axis so as to alternatively engage a release and retain mechanism and a uni-directional drive mechanism, a release pin attached to the shaft and oriented generally perpendicular to the longitudinal axis of the shaft, a drive pin attached to the shaft and oriented generally perpendicular to the longitudinal axis of the shaft, and a mechanism for affecting the axial movement of the shaft;

a release and retain mechanism comprising a biased release lever defining a slot, the slot being sized to receive the mast, the release lever normally engaging the mast, the release lever when engaging the mast allowing movement of the movable assembly in the first direction toward said fixed jaw and preventing movement of the movable assembly in a second direction away from the fixed jaw, the release lever being positioned to disengage from the mast when the shaft from the switching mechanism is first rotated to position the release pin proximal to the release lever and subsequently displaced longitudinally, the release lever when disengaged from the mast allowing free movement of the movable assembly both toward and away from the fixed jaw;

a uni-directional drive mechanism comprising a biased drive lever defining a slot, the slot being sized to receive the mast, the drive lever normally being disengaged from the mast, the drive lever being positioned to engage the mast when the shaft from the switching mechanism is first rotated to position the drive pin proximal to the drive lever and subsequently displaced longitudinally, the drive lever when engaging the mast providing incremental movement of the movable assembly toward the fixed jaw; and said release and drive pins being positioned at different orientations around the longitudinal axis of the shaft so as to preclude simultaneous engagement of the release and retain mechanism and the uni-directional drive mechanism.

17. The apparatus of claim 16 wherein at least one of the release lever and drive lever is biased with a spring.

18. The apparatus of claim 16 wherein the biased release lever, when normally engaging the mast, and the biased drive lever, when normally disengaged from the mast, are positioned transverse to the mast but not perpendicular to the mast.

19. The apparatus of claim 16 wherein the release and drive levers define circular slots.

20. The apparatus of claim 16 wherein the mechanism for affecting the axial movement of the shaft comprises a cam, the rotational center of the cam being offset from the physical center of the cam, the cam positioned within the movable assembly adjacent the shaft so as to subject the shaft to axial movement along its longitudinal axis when the cam is rotated, and an arm extending from the movable assembly and coupled to the cam so as to achieve the axial movement.

21. The apparatus of claim 20 wherein the cam has a nub positioned on the exterior surface of the cam.

22. The apparatus of claim 16 wherein the shaft is comprised of a first stem and a second stem; the first stem coupled at one end to the switch and having at least one transverse pin positioned at the other end; and the second stem having a first end with two forked extensions, the extensions straddling the transverse pin of the first stem, and a second end positioned adjacent to the mechanism for affecting the axial movement of the shaft; wherein rotation of the switch causes the rotation of the first stem and the second stem.

23. The apparatus of claim 22 wherein the release pin and the drive pin are positioned on the second stem and wherein axial movement of the second stem occurs without a concomitant axial movement of the first stem and switch.

* * * * *

UNITED STATES PATENT AND TRADEMARK OFFICE

CERTIFICATE OF CORRECTION

PATENT NO. : 6,164,626
DATED : December 26, 2000
INVENTOR(S) : Jeffrey B. Hille

It is certified that error appears in the above-identified patent and that said Letters Patent is hereby corrected as shown below:

Column 10,
Line 8, delete "tie" and insert -- the --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*